US006110056A

United States Patent [19]

Yamamoto

[11] Patent Number: 6,110,056

[45] Date of Patent: Aug. 29, 2000

[54] GOLF CLUB GROUP

[75] Inventor: Shinji Yamamoto, Hiratsuka, Japan

[73] Assignee: The Yokohama Rubber Co., Ltd., Tokyo, Japan

[21] Appl. No.: 09/081,592

[22] Filed: May 20, 1998

[30] Foreign Application Priority Data

May 23, 1997 [JP] Japan ..... 9-133818
Jun. 26, 1997 [JP] Japan ..... 9-170284

[51] Int. Cl.[7] ..... A63B 53/00

[52] U.S. Cl. ..... 473/289; 473/319; 273/DIG. 7; 273/DIG. 23

[58] Field of Search ..... 473/316, 317, 473/318, 319, 320, 321, 322, 323, 289; 273/DIG. 7, DIG. 23

[56] References Cited

U.S. PATENT DOCUMENTS 3,646,610 2/1972 Jackson ..... 473/319
4,240,631 12/1980 MacDougall ..... 473/289
5,049,422 9/1991 Honma ..... 428/34.6
5,324,032 6/1994 Minami .
5,421,573 6/1995 Kawamatsu ..... 473/319
5,569,099 10/1996 Jackson ..... 473/319
5,720,671 2/1998 Cheng ..... 473/305
5,721,030 2/1998 Okada ..... 473/319

*Primary Examiner*—Jeanette Chapman
*Assistant Examiner*—Stephen L. Blau
*Attorney, Agent, or Firm*—Finnegan, Henderson, Farabow, Garrett & Dunner, L.L.P.

[57] ABSTRACT

Disclosed is a golf club group comprising a plurality of golf clubs having the same number, in which each golf club shaft of the golf club is composed of a plurality of bias layers and a plurality of straight layers which are wind-formed so that it may be shaped into a tapered circular pipe having a diameter which gradually larger towards to is a butt end. The plurality of golf club shafts have approximately the same flexibility, assuming that each golf club shaft is constructed so that each straight layer may have the same thickness over the total length of the shaft, a distribution curve of flexural rigidity the shaft is set as a reference curve. Then, a tangent line is drawn at the position Q of the reference curve located 300 mm apart from the butt end, whereby golf clubs are categorized in the following manner: the golf club for a swinger is the golf club having the golf club shaft of which the distribution curve of flexural rigidity in a butt side portion extending from the position Q to the butt end is within a region on or lower than the tangent line, and the golf club for a hitter is the golf club having the golf club shaft of which the distribution curve of flexural rigidity in the butt side portion is within a region higher than the tangent line.

7 Claims, 6 Drawing Sheets

GOLF CLUB GROUP

BACKGROUND OF THE INVENTION

The present invention relates to a golf club group in which a plurality of golf clubs of the same number are categorized by a swing type, one of golf clubs constituting the golf club group and a fiber reinforced resin golf club shaft constituting the golf club.

In general, golfers are broadly categorized by his swing characteristics into the two following types. One type of golfer is a so-called "swinger" who swings a golf club while bending a golf club shaft 12 by turning his wrist 11 from the beginning of swing A so that a club head 13 describes a relatively large approximately circular arc X around a swing center O, as shown in FIG. 7.

Another type of golfer is a so-called "hitter" who swings the golf club without turning his wrist 11 at the beginning of swing so that the club head 13 describes a relatively small approximately circular arc Y around the swing center 0 and then accelerates a head speed while sharply turning his wrist at the time of impact J, as shown in FIG. 8.

Heretofore, as a criterion for thus categorizing golf clubs in a manner suitable for the swing characteristics, the flexibility and bend point indicating flexural rigidity properties of the whole golf club shaft have been used. The golf clubs are categorized in the following manner, for example. The golf club having the golf club shaft of high flexibility, that is, the golf club with a relatively soft shaft, is suitable for the swinger, while the golf club having the golf club shaft of low flexibility, that is, the golf club with a relatively hard shaft, is suitable for the hitter. Alternatively, the golf club having the golf club shaft whose bend point is closer to a tip end and which is of low flexural rigidity near the tip end is suitable for the swinger, while the golf club having the golf club shaft whose bend point is closer to a butt end and which is of high flexural rigidity near the tip end is suitable for the hitter.

In the case of selling the same brand of golf club group including two kinds or more of golf clubs which are of the same number and of different properties of the golf club shafts, golf club makers mark the golf clubs with characters, patterns or the like so as to thereby categorize the golf clubs in such a manner that the swinger or the hitter can be easily select the suitable golf club from this golf club group in accordance with his own characteristics.

However, since a method of categorizing the golf clubs by the use of the above-described flexibility and bend point is not the categorizing method in which the swinger and the hitter can sufficiently hit a ball in their ways, the above-mentioned method is not necessarily satisfactory.

That is, the method of categorizing the golf clubs by means of the flexibility and bend point is accomplished by categorizing the golf club having the shaft of characteristics considered to be physically appropriate on the basis of the characteristics of swing speed and trajectory in terms of the swing speed estimated from the characteristics of swing type and the experientially known characteristics of trajectory. This categorizing method does not take golfer's sensitivity into consideration, and it does not analyze/consider shaft deformation in a swing process.

SUMMARY OF THE INVENTION

It is an object of the present invention to provide a golf club group which is adapted so that a plurality of same-numbered golf clubs can be categorized in a manner optimal for the characteristics of golfer's swing type.

Another object of the present invention is to provide a golf club and a fiber reinforced resin golf club shaft more particularly suitable for a swinger.

In order to achieve the above object, a golf club group of the present invention comprises a plurality of golf clubs having the same number in which each golf club shaft of the golf clubs is composed of a plurality of bias layers with reinforcing fibers arranged obliquely in an axial direction of a shaft and a plurality of straight layers with reinforcing fibers arranged parallel to the axial direction of the shaft which are formed by winding so that they may be shaped into a tapered circular pipe having a diameter which is gradually larger towards a butt end, wherein each golf club shaft has approximately the same flexibility and assuming that each golf club shaft is constructed so that each straight layer may have the same thickness over the total length of the shaft, a distribution curve of flexural rigidity of the shaft is set as a reference curve and then a tangent line is drawn at the position Q of the reference curve located 300 mm apart from the butt end, whereby said golf clubs are categorized in the following manner: the golf club for a swinger is one having a golf club shaft in which the distribution curve of shaft flexural rigidity in a butt side portion extending from the position Q to the butt end is within a region on or lower than the tangent line, and the golf club for a hitter is one having a golf club shaft in which the distribution curve of shaft flexural rigidity in the butt side portion is within a region higher than the tangent line.

According to the result of the inventor's study, since the swinger turns his wrist at the beginning of swing, an inertia force applied to a golf club head is directed closer to the direction perpendicular to the shaft in a swing process before an impact. Thus, the portion near the butt of the shaft, that is, the portion near a grip of the club directly gripped by the golfer is flexed. Since the golfer controls the swing while feeling this flexure of the shaft at his hand, the golf club which is easy to perceive the flexure is preferable. On the other hand, the hitter turns his wrist immediately before the impact by using a grip potion as the point of a lever where the force is applied, whereby an attempt is made to maximize a head speed and a hitting energy at the time of the impact. Thus, the golf club which is easy to stably transfer a great force is preferable. A conventional category has not been able to be sufficiently adapted to such a requirement.

According to the present invention, in the golf club group having a set of golf club shafts having substantially the same flexibility as described above, the club having the shaft in which the distribution of shaft flexural rigidity in the butt side portion extending from the butted to a position located 300 mm apart from the butt end is lower than the tangent line drawn at the position Q of the reference curve is grouped in the category of the golf club for the swinger. Therefore, since the shaft flexural rigidity near the grip is relatively low, the swinger readily feels the flexure at his hand. As a result, a shot can be accomplished at a swing timing and a strength/ weakness of swing force as imagined. On the other hand, the golf club having the shaft in which the distribution of shaft flexural rigidity in the butt portion is higher than the tangent line is placed in the category of the golf club for the hitter. Therefore, since the shaft flexural rigidity near the grip is relatively high, the hitter can stably accelerate the head speed at the time of the impact. Thus, the highest possible hitting energy can be applied to a golf ball at the time of the shot.

A golf club of the present invention has a fiber reinforced resin golf club shaft comprising a plurality of bias layers and a plurality of straight layers which are formed by winding so that it may be shaped into a tapered circular pipe having a diameter which is gradually larger towards a butt end, each of said plurality of bias layers having reinforcing fibers arranged obliquely in the axial direction of the shaft, each of said plurality of straight layers having reinforcing fibers arranged parallel to the axial direction of the shaft, wherein said plurality of straight layers are composed of at least three layers whose lengths are equal to each other in the axial direction of the shaft, each of at least three layers of said at least three straight layers has at least one lack portion whose width is gradually increased towards to the butt end within at least the region from a position Q located 300 mm apart from the butt end toward a tip end to the butt end, and these lack portions are substantially equally spaced in the circumferential direction of the shaft.

Moreover, a fiber reinforced resin golf club shaft of the present invention comprises a plurality of bias layers with reinforcing fibers arranged obliquely in the axial direction of the shaft and a plurality of straight layers with reinforcing fibers arranged parallel to the axial direction of the shaft which are wind-laminated so that they may be shaped into a tapered circular pipe having a diameter which is gradually larger towards a butt end, wherein the plurality of straight layers are composed of at least three layers whose lengths are equal to each other in the axial direction of the shaft, each of at least three layers of the at least three straight layers has at least one lack portion whose width is gradually increased towards the butt end within at least the region from the butt end to the position Q located 300 mm apart from the butt end toward the tip end, and these lack portions are substantially equally spaced in the circumferential direction of the shaft.

The butt side portions of the straight layers are provided with the lacks of the reinforcing fibers whose widths are gradually increased, whereby it is possible to reduce the thickness near the butt end to which the grip is attached and to reduce the flexural rigidity. Thus, the flexure on the grip can be easily perceived. Therefore, the swinger who controls the swing by perceiving the flexure on the grip during the swing can get the shot at the swing timing and the strength/weakness of swing force as imagined, thereby allowing a carry to be easily controlled. Furthermore, since the lack portions are substantially equally spaced in the circumferential direction of the shaft, the thickness of the butt end side is little varied in the shaft circumferential direction, and thus the strength is not locally considerably reduced.

DETAILED DESCRIPTION OF THE PREFERRED EMBODIMENT

Figure 1:
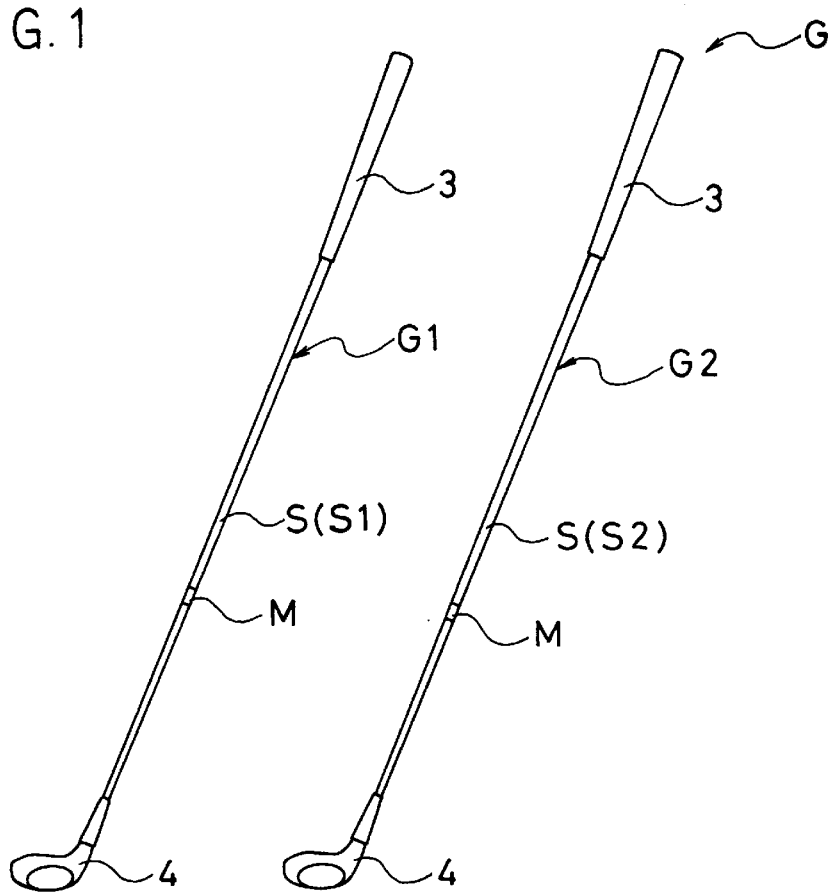
FIG. 1 is a front view showing an example of a golf club group of the present invention.

In general, a golf club shaft is tapered so that its outer diameter is gradually larger towards a butt end to which a grip is mounted and its outer diameter is gradually smaller towards a tip end to which a head is mounted. When the club shaft is composed of fiber reinforced resin, the reinforcing fibers of fiber reinforced resin sheets composing the shaft have anisotropy because they are aligned in one direction. Bias layers composed of the reinforcing fibers arranged obliquely in the axial direction of the shaft are designed so that they may dominate rigidity in a shearing direction with the axis of the shaft, namely, torsional rigidity. On the other hand, straight layers composed of the reinforcing fibers arranged parallel to the axial direction of the shaft are designed so that they may dominate flexural rigidity. The influence of the bias layers on the flexural rigidity is about 10% of the entire influence.

The bias layers, which are thicker (increased in the number of layers) in the tip end side and which are thinner (reduced in the number of layers) in the butt end side, have been heretofore used. However, the straight layers have been adapted so that the thickness (the number of layers) is the same from the tip end to the butt end in order to uniformly keep the flexural rigidity in a circumferential direction.

In the case of the conventional fiber reinforced resin shaft using carbon fibers or the like having the straight layers of the same constant thickness from the tip end to the butt end, the perception of flexure on the grip is very difficult for a swinger who perceives the flexure on the grip and then controls a swing speed (head speed) in accordance with the perceived flexure so as to thereby hit a ball in a trajectory and a carry as imagined when swinging. Thus, it is said that he can't obtain the trajectory and the carry as imagined and many misshots are caused. On the other hand, it is said that the conventional shaft is suitable for a hitter who controls the acceleration of the head speed at the time of impact so as to thereby hit the ball in the trajectory and the carry as imagined, because the stronger impact due to the stable grip portion permits the carry to be increased and the shot is also easily stabilized.

As the result of the inventor's study of these points, the flexural rigidity of the fiber reinforced resin shaft is expressed by an equation representing EI (where E: a modulus of elasticity, I: a quadratic moment of shaft cross section). This equation proves that, in the case of the constant thickness, the flexural rigidity on a point located a distance x apart from the tip end is caused due to that a rate of increase of the flexural rigidity of the butt end portion is much higher than the rate of increase in the center area of the shaft.

That is, in the case of the fiber reinforced resin shaft of a tapered structure composed of the wind-laminated bias layers and straight layers, the shaft flexural rigidity is greatly influenced by the straight layers, but it is little associated with the bias layers. Therefore, if the distribution of flexural rigidity of the shaft is considered on the assumption that the flexural rigidity of the fiber reinforced resin shaft is substantially dominated by the flexural rigidity based on the straight layers, the equation for calculating the distribution of flexural rigidity is represented by the following equation (1). It should be noted that the fiber reinforced resin shaft has a single tapered structure, namely, a basic shape (where an outer diameter is increased by a linear equation for the distance x) as an example. Accordingly, a shaft outer diameter $D_0$ is expressed by $D_0=ax+b$ (where x denotes the distance parallel to the shaft axis from the tip end toward the butt end). Also, t denotes the thickness of the straight layers.

$$\begin{aligned} EI &= E\times(\ /64)\times(D_0^4-(D_0-2t)^4) \qquad (1)\\ &= E\times(\ /64)\times(8tD_0^3-24t^2D_0^2+32t^3D_0-16t^4)\\ &= E\times(\ /64)\times(8t(ax+b)^3-24t^2(ax+b)^2+32t^3(ax+b)-16t^4) \end{aligned}$$

In such a manner, the shaft flexural rigidity on the point of the distance x is represented by a cubic equation for the distance x. The closer the point comes to the butt end, the more the shaft flexural rigidity is increased.

Therefore, the inventor gave attention to the shaft flexural rigidity on the nearer points at hand with which a golfer perceived the flexure. That is to say, a portion of the golf club gripped by the golfer was located in an area between the butt end and the position about 170 mm apart from the butt end. Moreover, a portion (the middle and medical fingers) firmly gripped by the left hand (in the case of the right-handed golfer) which was important during a down swing was within a region 60–70 mm apart from the butt end. Since the swinger swung the club while feeling the flexure of the shaft at hand by the middle and medical fingers, it was found that there was a need for reducing the shaft flexural rigidity in the butt end portion ranging from the butt end to the position 70 mm apart from the butt end toward the tip end. On the other hand, since the hitter attempted to maximize the head speed and hitting energy at the time of the impact, it was desirable that the flexural rigidity was high in the grip portion including the butt end portion.

Therefore, as a result of an earnest study, it was found that it was easy for a swinger to feel the flexure in the grip portion by lowering the shaft flexural rigidity in a grip portion by way of disposing lack portions gradually increasing their width towards the butt end in an area between a position Q 300 mm apart from the butt end towards the tip end and the butt end in the straight layers of the fiber reinforced resin golf club shaft. On the other hand, it was realized that it was difficult for a swinger to feel the flexure in the grip portion and was easy for a hitter to hit a golf ball by disposing the lack portions in an area nearer to the butt end than the position Q.

Accordingly, in a golf club group comprising golf clubs with the same number, assuming that each golf club shaft of the golf clubs is constructed so that each straight layer may have the same thickness over the total length of the shaft, a distribution curve of flexural rigidity of the shaft is set as a reference curve and then a tangent line is drawn at the position Q of reference curve located 300 mm apart from the butt end, whereby the golf clubs are categorized in the following manner: a golf club for the swinger is one having a golf club shaft of which distribution of flexural rigidity in a butt side portion between the position Q and the butt end is on or lower than the tangent line, and a golf club for the hitter is one having a golf club shaft of which distribution of flexural rigidity is higher than the tangent line. Moreover flexibility of each golf club shaft in the golf clubs of the gold club group is needed to be substantially the same since an amount of flexure of each shaft is substantially equalized at the time of impact when a golf ball is hit at the same speed (head speed).

The construction of the present invention will be described in detail below with reference to the accompanying drawings.

In FIG. 1, reference numerals G1, G2 denote the golf clubs having the same number. In this example, a golf club group G comprises two wood type golf clubs G1, G2. In each of the golf clubs G1, G2, a grip 3 is attached to a golf club shaft S on the side of the butt end, and a club head 4 is mounted to the golf club shaft S on the side of the tip end. Reference symbol M denotes a mark for categorizing the golf clubs G1, G2 by different types of swing forms. Each golf club shaft S is labeled with this mark.

Figure 2A:
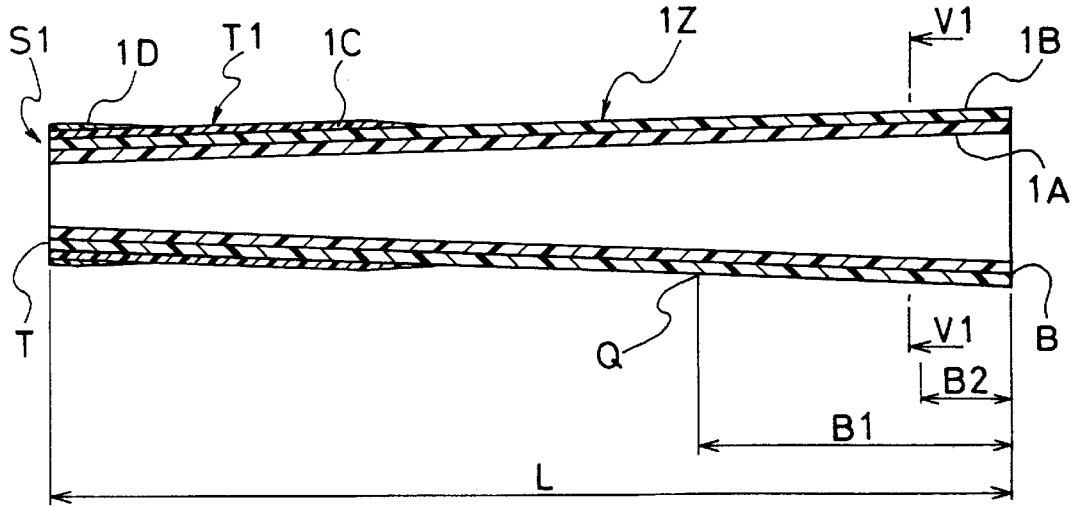
FIG. 2*a* is a vertical sectional view of an exemplary golf club shaft for use in a golf club for a hitter in the golf club group of the present invention, showing a length in an axial direction of a shaft scaled down with respect to a diametrical length for facilitating an understanding.
Figure 2B:
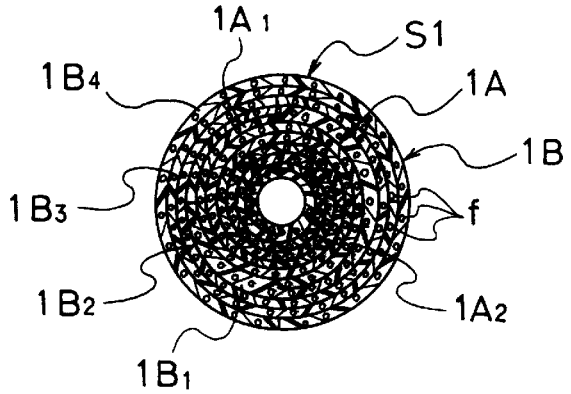
FIG. 2*b* is a cross sectional view taken on line V1—V1 of FIG. 2*a*, showing a scaled-down shaft hollow portion while showing an enlarged view of the shaft thickness portion for facilitating the understanding.
Figure 2C:
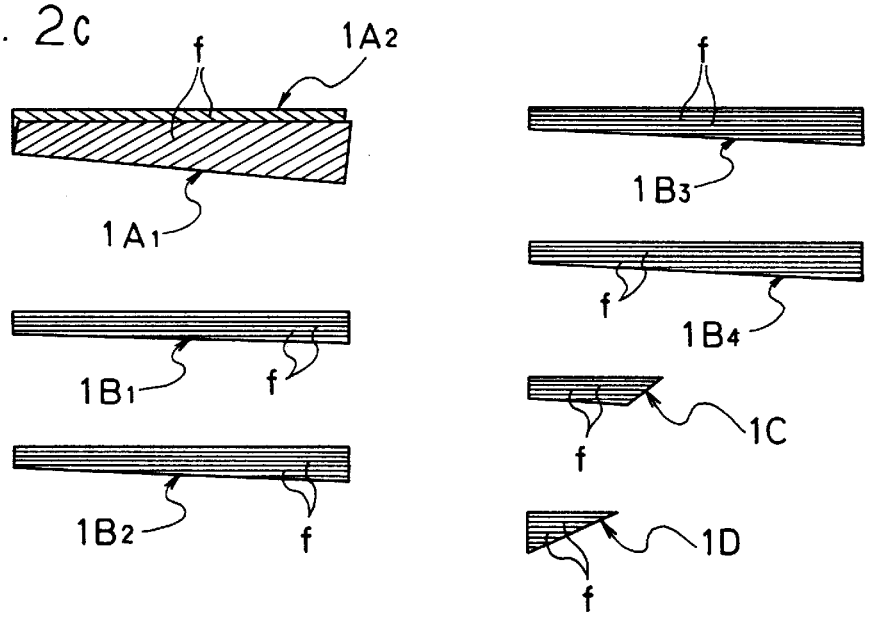
FIG. 2*c* is an exploded view of layers of the exploded golf club shaft of FIG. 2*a;*
Figure 3A:
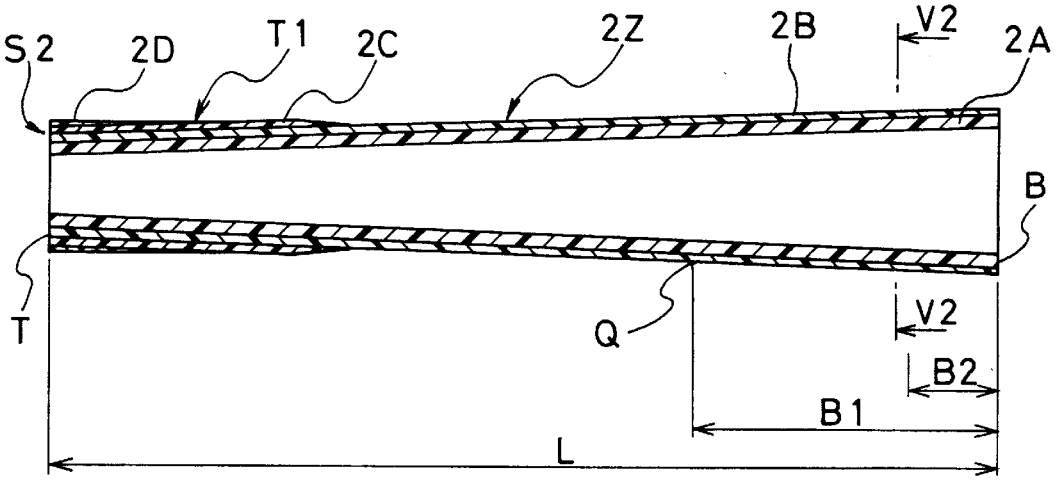
FIG. 3*a* is a vertical sectional view of an exemplary golf club shaft for use in the golf club for a swinger in the golf club group of the present invention, showing the length in the axial direction of the shaft scaled down with respect to the diametrical length for facilitating the understanding.
Figure 3B:
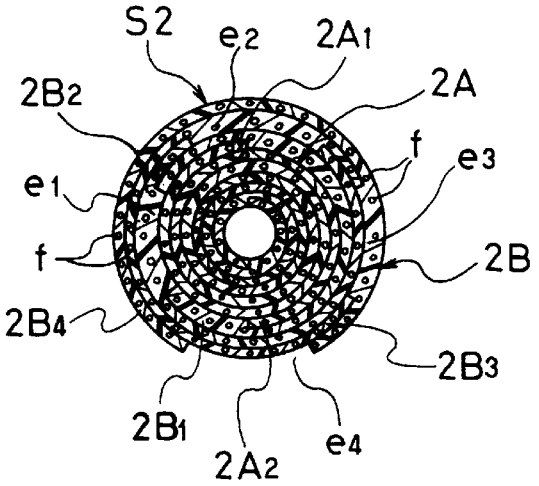
FIG. 3*b* is a cross sectional view taken on line V2—V2 of FIG. 3*a*, showing the scaled-down shaft hollow portion while showing an enlarged view of the shaft thickness portion for facilitating the understanding.

As shown in FIGS. 2 and 3, golf club shafts S1, S2 of the golf clubs G1, G2 comprise bias layer groups 1A, 2A constituted of six bias layers composed of reinforcing fibers f arranged obliquely in the axial direction of the shaft; straight layer groups 1B, 2B constituted of four straight layers composed of the reinforcing fibers f arranged parallel to the axial direction of the shaft; tip reinforcing layers 1C, 2C constituted of a single layer composed of the reinforcing fibers f arranged parallel to the axial direction of the shaft; and parallel reinforcing layers 1D, 2D, for constituting tip parallel portions, constituted of a single triangular layer composed of the reinforcing fibers f arranged parallel to the axial direction of the shaft. Also, a total shaft length L has the same dimension.

Figure 3C:
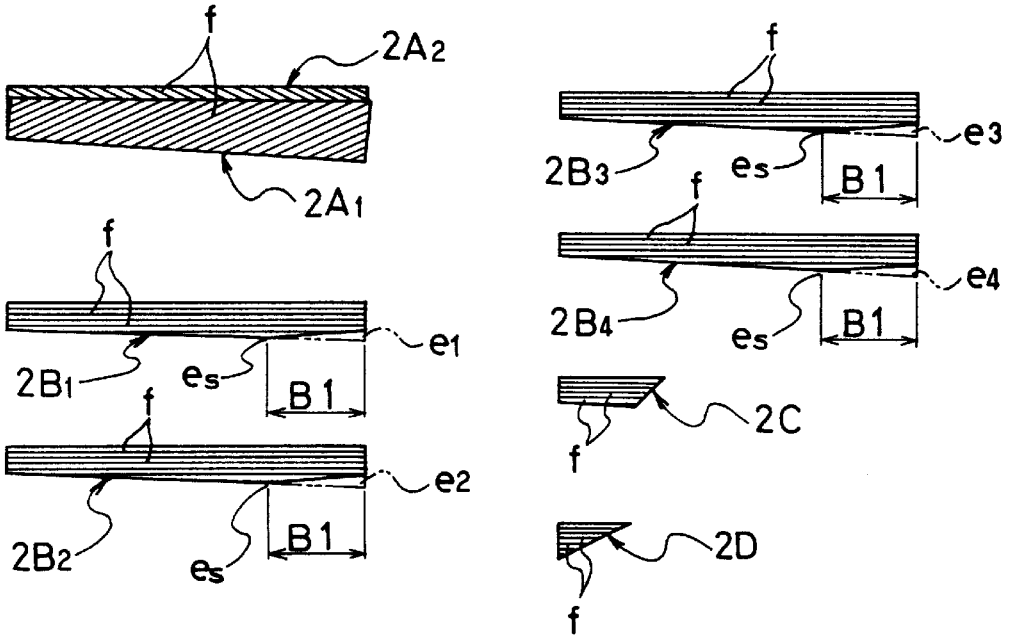
FIG. 3*c* is an exploded view of the layers of the exploded golf club shaft of FIG. 3*a;*

As shown in FIGS. 2*c* and 3*c*, the bias layer groups 1A and 2A comprise three rolls of wrap of two bias layer pieces $1A_1$, $1A_2$ and $2A_1$, $2A_2$, respectively, which cross each other so that the inclining directions of the reinforcing fibers f with respect to the axial direction of the shaft are opposite to each other and which have the same thickness.

The straight layer group 1B of the shaft S1 is constituted so that each of single straight layers $1B_1$, $1B_2$, $1B_3$, $1B_4$ may have the width of one roll of wrap. The straight layers have the reinforcing fibers f over the total shaft length L ranging from a tip end T to a butt end B and thus have the same thickness.

On the other hand, the straight layer group 2B of the shaft S2 is constituted so that each of single straight layers $2B_1$, $2B_2$, $2B_3$, $2B_4$ may have the width of one roll of wrap within the region between the position Q 300 mm apart from the butt end B toward the tip end T and the tip end T. However, since a butt-side portion B1 ranging from the position Q to the butt end B has lack portions $e_1$, $e_2$, $e_3$, $e_4$ whose widths are gradually increased toward the butt end B, the portion B1 does not have the width of one roll of wrap. The straight layers $2B_1$, $2B_2$, $2B_3$, $2B_4$ are laminated so that the lacks $e_1$, $e_2$, $e_3$, $e_4$ may be substantially equally spaced in the circumferential direction of the shaft. The thickness of the straight layer group 2B becomes gradually thinner, as it comes closer to the butt end B in the butt-side portion B1. The lacks $e_1$, $e_2$, $e_3$, $e_4$ are substantially equally spaced in the circumferential direction of the shaft, whereby the thickness is little varied in the circumferential direction in the butt end side, and this prevents the strength from being locally considerably reduced.

By a sheet wrapping method, the shafts S1, S2 are formed in such a manner that the straight layer groups 1B, 2B are wind-laminated on the outer periphery of the bias layer groups 1A, 2A; the tip reinforcing layers 1C, 2C are wrapped on a tip end T1 on the outer periphery of the straight layer groups 1B, 2B; and the parallel reinforcing layers 1D, 2D are wrapped on the outer periphery of the tip reinforcing layers 1C, 2C, respectively.

In the above-mentioned shafts S1 and S2, shaft bodies 1Z and 2Z constituted of the bias layer groups 1A, 2A and the straight layer groups 1B, 2B, respectively, are shaped into a tapered circular pipe having diameter which is larger towards the butt end B. A ratio of taper is set at $6/1000$ through $15/1000$.

The shafts S1, S2 have substantially the same flexibility. That is, the shaft S1 is uniformly constituted so that the single straight layers $1B_1$, $1B_2$, $1B_3$, $1B_4$ may have the same thickness. On the other hand, the shaft S2 having the lack portions $e_1$, $e_2$, $e_3$, $e_4$ is constituted so that the third and fourth straight layers $2B_3$, $2B_4$ may have the same thickness as the straight layers of the shaft S1 but the first and second straight layers $2B_1$, $2B_2$ may be thicker than the straight layers of the shaft S1, whereby, in the center area of the shaft, the flexural rigidity distribution of the shaft S2 is higher than that of the shaft S1. The adoption of this constitution allows the shafts S1, S2 to have substantially the same flexibility. The flexibility of one shaft is substantially equalized with that of the other shaft, whereby an amount of flexure of one shaft is substantially the same as that of the other shaft at the time of the impact when the ball is hit at the same swing speed (head speed). If the flexibility differs between the shafts, the golf clubs cannot be optimally categorized by the characteristics of swing types.

Figure 4:
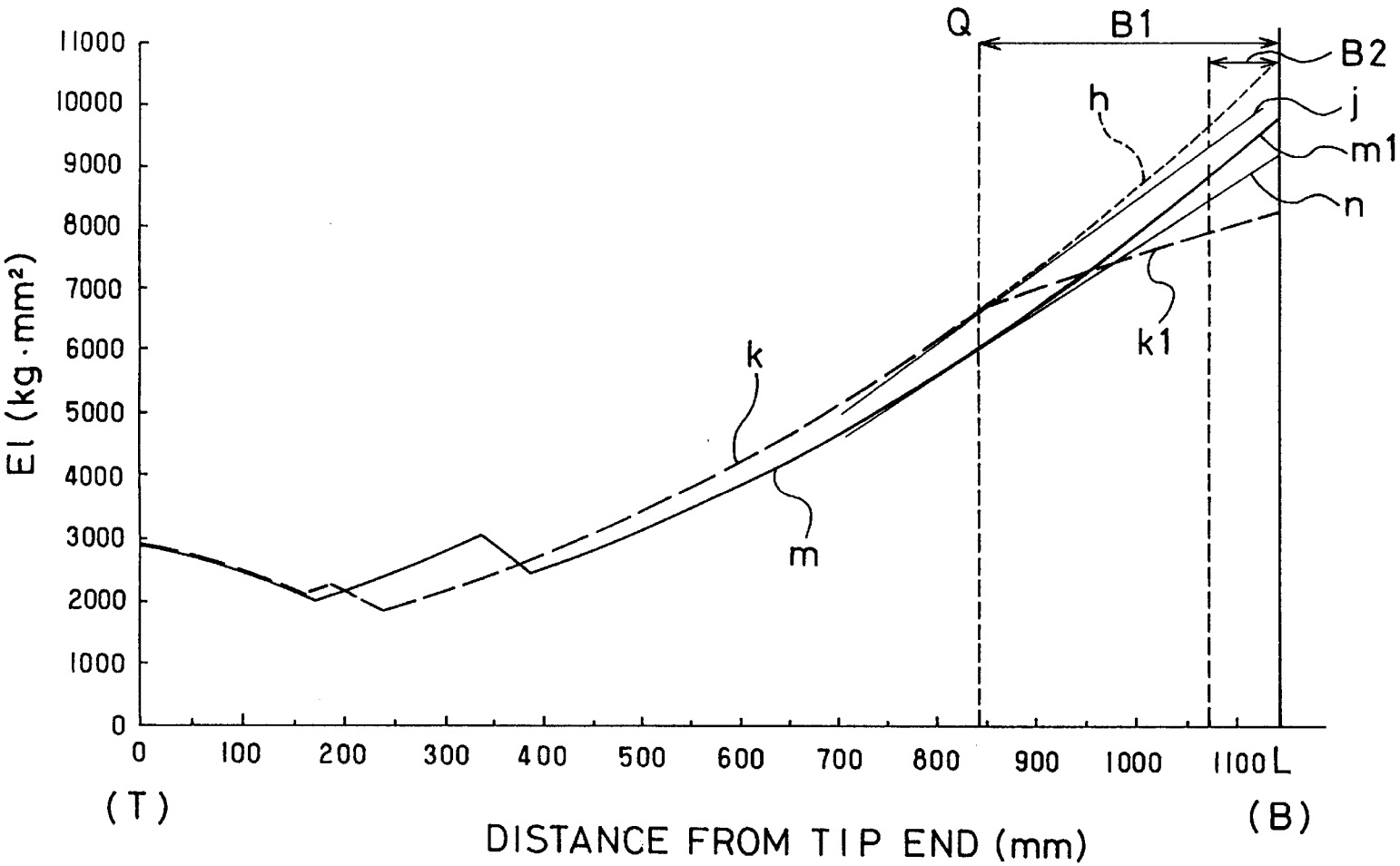
FIG. 4 is a graph showing an example of distribution of shaft flexural rigidity of the golf club shaft of FIGS. 2*a* and 3*a;*

FIG. 4 shows an example of the distribution of shaft flexural rigidity of the shafts S1, S2 of the above-described constitution. A solid line m represents the distribution of flexural rigidity of the shaft S1, while a broken line k represents that of the shaft S2.

In the case of the shaft S1, over the total shaft length L from the tip end T to the butt end B, although the flexural rigidity is increased/decreased in response to the positions into which the reinforcing layers 1C, 1D are inserted within the range of the tip end portion T1 where the reinforcing layers 1C, 1D are disposed, the flexural rigidity is substantially gradually increased towards the butt end B by a cubic curve as expressed by the aforementioned equation (1) in the portion extending from an end of the tip end portion T1 to the butt end.

On the other hand, in the case of the shaft S2, the flexural rigidity in a tip end portion T2 is increased/decreased and the flexural rigidity in the region between an end of the tip end portion T2 and the position Q where the lacks $e_1$, $e_2$, $e_3$, $e_4$ of the straight layers $2B_1$, $2B_2$, $2B_3$, $2B_4$ start is gradually larger towards the butt end B by a cubic curve in the same manner as shown by the curved line m. In the butt-side portion B1 between the position Q and the butt end B, the position Q is set as a point of inflection and the flexural rigidity is gradually increased at a low rate of increase, so that the increase of the shaft flexural rigidity is minimized on the side of the grip.

The shafts S1, S2 have the same shaft length and substantially the same flexibility and are used for golf clubs of the same number. But they have different distributions of shaft flexural rigidity.

According to the present invention, as described above, the golf club group G comprising a set of two golf clubs G1, G2 have the same number and each shaft S1, S2 has a different distribution of shaft flexural rigidity and substantially the same flexibility, assuming that the straight layers have the same thickness over the total shaft length. The different distributions of shaft flexural rigidity for the respective shafts S1 and S2 are represented by the two curves of FIG. 4. That is to say, the reference curve of the shaft S1 coincides with the distribution curve m of the flexural rigidity in the region beyond the tip end portion T1 where the reinforcing layers 1C, 1D are arranged. The reference curve of the shaft S2 coincides with the distribution curve k of the flexural rigidity in the region between an end of the tip end portion T1 where the reinforcing layers 2C, 2D are arranged and the position Q, and then the reference curve of the shaft S2 is shown by a dotted curved line h in the butt-side portion B1 beyond the position Q.

Figure 7:
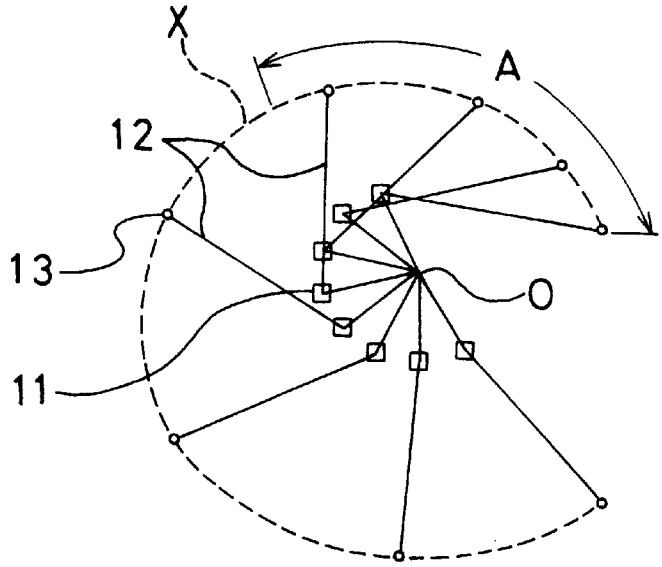
FIG. 7 illustrates the swing of the swinger swinging from the top to the position beyond the impact.
Figure 8:
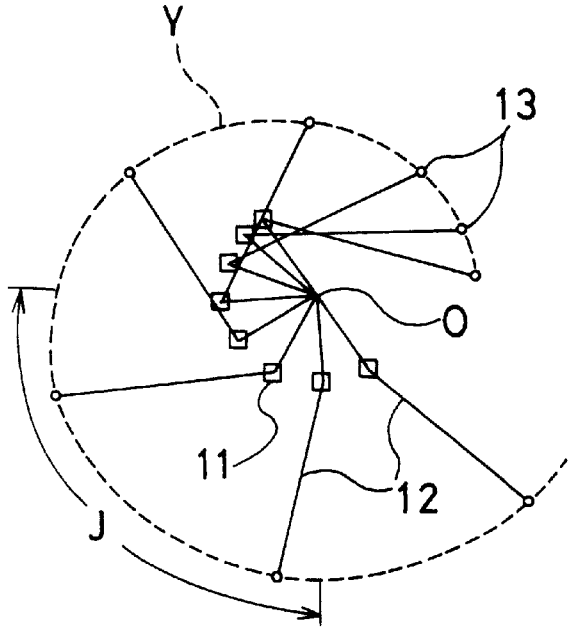
FIG. 8 illustrates the swing of the hitter swinging from the top to the position beyond the impact.

Tangent lines j, n are drawn at the position Q of the reference curves located 300 mm apart from the butt end B toward the tip end T. For the swinger who turns his wrist 11 from the beginning of swing A so as to hit the ball as shown in FIG. 7, the shaft S2 is provided. The shaft S2 may be called a swinger shaft in which the distribution of flexural rigidity is represented by the curves k and k1 in FIG. 4. The curve k1 begins at a point Q, where a line j is tangent to the curve k, lies in a region on or lower than the tangent line j, and extends to the butt end. On the other hand, for the hitter who sharply turns his wrist 11 at the time of impact I so as to hit the ball as shown in FIG. 8, the shaft S1, which may be called a hitter shaft, is provided. The distribution of flexural rigidity for the hitter shaft S1 is represented by the curves m and m1 in FIG. 4. In this shaft, the curve m1 lies above a line n that is tangent to the curve m at the point Q. Then, the shafts are labeled with the marks M indicating the categories so as to categorize the golf clubs of the group.

In the above-described group comprising the golf clubs G1, G2 having the shafts S1, S2, the golf club G1 is categorized as the club for the hitter, or a hitter club, while the golf club G2 is categorized as the club for the swinger or a swinger club. In such a manner, the golf club having the golf club shaft whose flexural rigidity is lower on the side of the hands (a butt end portion B2 between the butt end B and a position 70 mm apart from the butt end B) with which the golfer perceives the flexure is placed in the category of the golf club for the swinger, whereby the golfer easily perceives the conditions of the shaft flexure at his hand during the down swing. Accordingly, since the carry can be controlled with ease, this golf club is easy to swing for the swinger.

On the other hand, the golf club having the golf club shaft whose flexural rigidity is higher on the side of the hands with which the golfer perceives the flexure is grouped in the category of the golf club for the hitter, whereby the hitter can swing the golf club without uneasiness caused due to the flexure at the time of the impact. Thus, the head speed can be stably accelerated and the hitter can be obtained the trajectory and the carry as imagined.

By such a categorization, the golf clubs G1, G2 of the same number in the golf club group G can be categorized by an evaluation independent of a conventional method of determining the characteristics so that the golf clubs may be suitable for hitting approaches in accordance with golfer's swing types (the swinger and the hitter).

Figure 5:
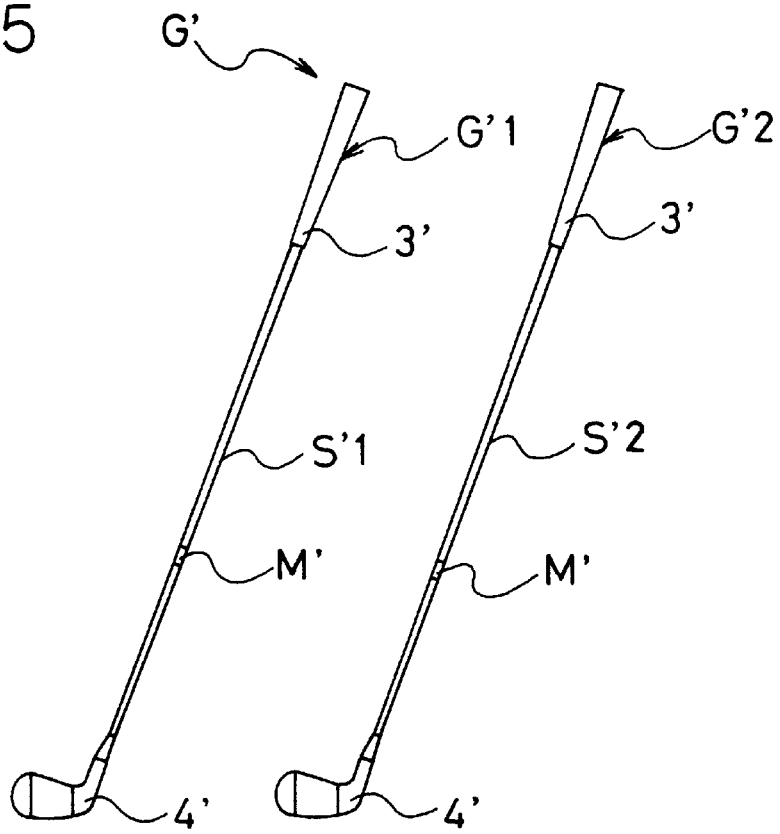
FIG. 5 is a front view of another example of the golf club group of the present invention.

FIG. 5 shows another example of the golf club group of the present invention, showing a golf club group G' comprising iron type golf clubs G'1, G'2 having the same number. In this drawing, numerals S'1, S'2 denote fiber reinforced resin golf club shafts having at least the bias layers and the straight layers. Numeral 3' denotes a grip. Numeral 4' denotes a club head. Reference symbol M' denotes a mark for categorizing the golf clubs by different types of swing forms. Even the golf clubs G'1, G'2 in this iron type golf club group G' is categorized in the above-mentioned manner, whereby each golf club can be categorized so that it may be suitable for the hitting approaches in accordance with the swing type. And fiber reinforced resin golf club shafts of iron type golf clubs suitable for the swinger can also be obtained by providing lack portions in the straight layers of each shaft as described above.

In the present invention, the known materials can be used as matrix resin constituting the bias layer groups 1A, 2A and the straight layer groups 1B, 2B. For example, it is possible to use thermosetting resin such as epoxy resin, phenolic resin and polyurethane resin; and thermoplastic resin such as polypropylene resin, polyether etherketone resin, ABS resin and nylon resin. Preferably, the epoxy resin is used.

The same materials as the prior art can be used as the fiber for use in the reinforcing fibers f of the bias layer groups and the straight layer groups. For example, it is possible to use carbon fiber, glass fiber, aramid fiber, boron fiber, alumina fiber, silicon carbide fiber or the like. Preferably, the carbon fiber having excellent specific strength and specific modulus is used.

The distributions of flexural rigidity of the golf club shafts can be found by the use of an anisotropic theory in the field of material dynamics, if the laminated structures of the shafts are known. Of course, the distributions of flexural rigidity may be also found by means of FEM (a finite element method: a method in which an object is divided into the finite number of fine elements and then the elements are considered to be bound to each other, whereby the physical properties of the elements are dynamically solved).

When the laminated structures are not known, for example, the flexural rigidities EI are found on the positions (namely, the points of levers where the forces are applied) from the result of a three-point bending test and then the flexural rigidities EI are plotted, whereby the distribution of shaft flexural rigidity can be determined. In this case, it is desirable that a span between fulcrums is set to 150–50 mm. The measurements employing the above-mentioned methods cause an absolute value of EI to be varied. More specifically, in the case of the three-point bending test, the shorter the span becomes, the higher the value becomes. However, this fact has no influence upon the categorization of the present invention.

The equation for finding the value of EI from the result of the three-point bending test is as follows:

$$EI=Pl^3/48$$

where P: a load (kgf), 1: a span (mm) and : an amount of displacement (mm).

Figure 6:
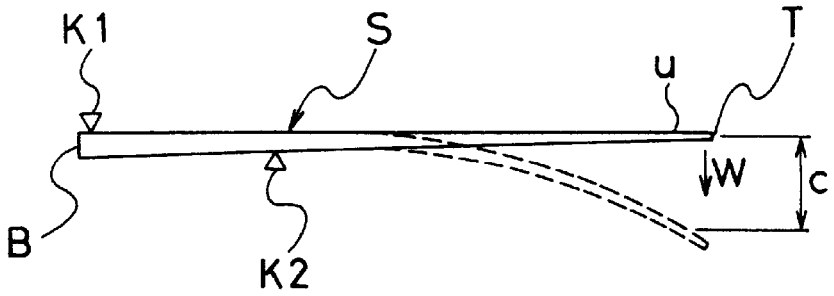
FIG. 6 illustrates a method of measuring flexibility in the golf club group of the present invention.

The flexibility of the present invention is measured in the following manner. That is, as shown in FIG. 6, the shaft S is horizontally supported by supporting instruments K1, K2 on two points 10 mm and 280 mm apart from the butt end B, and then a load W of 1.5 kgf is applied to the position U 30 mm apart from the tip end T. At this time, an amount of flexure c (mm) of the shaft S is measured on the position U. The description that the shafts have substantially the same flexibility in the present invention means that a difference in the amount of flexure c between each shaft is equal to or less than 5 mm.

The method of substantially equalizing the flexibility is not particularly limited, and the known methods can be thus used. For example, the flexibility can be substantially equalized by adjusting the material, shape, thickness or the like of the straight layers.

The above-described golf club shafts may have the same inner diameter formed by the same shaped mandrel. Alternatively, the shafts may also have different inner diameters. In short, as long as the shafts are used for golf clubs with the same number and have substantially the same flexibility, any shafts are available.

Although each number of the laminated bias layers and the laminated straight layers in the golf club shafts S1 is the same as that of the laminated bias layers and the laminated straight layers in the shaft S2 on the assumption that the same material is used in the embodiments, as long as the shafts have substantially the same flexibility and are used for golf clubs having the same number, the number of laminated layers may differ between them.

The golf club group comprising two golf clubs is described above in the embodiments. But the golf club group of the present invention can comprise a plurality of golf clubs more than two. The number of golf clubs is not particularly limited.

In the present invention, a golf club and a fiber reinforced resin golf club shaft S2 suitable for a swinger are the golf club G2 and the fiber reinforced golf club shaft as described above. The lack portions $e_1$, $e_2$, $e_3$, $e_4$ are provided at least in the butt side portion B1 and substantially spaced in the circumferential direction of the shaft. If the lack portion $e_1$, $e_2$, $e_3$, $e_4$ start beyond the position Q to the butt end B, it is not so easy for a swinger to feel the shaft flexure in a grip portion. If they start nearer towards the butt and B, it is more difficult for a swinger to feel it. If they are provided in the region beyond the position Q to the butt end B and the shaft flexural rigidity is lowered so that a swinger may feel the shaft flexure in the grip portion, the shaft flexure rigidity in the grip portion varies widely. As the result, the grip portion receives stress concentration while hitting so that it has a danger to be broken. It is unpreferable.

The lack portion $e_1$, $e_2$, $e_3$, $e_4$ may be disposed to the butt end B from a position corresponding to 40% of the total shaft length L from the tip end T. Each lack starting end $e_s$ can be located in an area between the position of 40% of the total shaft length L from the tip end T and the position Q. If they start from a tip end side out of the area, it is difficult to adjust a position of the center of gravity, bend point and the like in the shaft by providing reinforcing layers in the tip portion. It is unpreferable as losing a lot of freedom according to a shaft design.

Preferably, the distribution of shaft flexural rigidity lowered by providing the lacks in the butt-side portion B1 is continuously gradually increased until it reaches the butt end B, as shown in FIG. 4. However, the present invention is not limited to this example. Within the allowable range of the shaft flexural rigidity, the distribution may be continuously gradually decreased or the distribution curve may coincide with a distribution straight line parallel to a horizontal line where the flexural rigidity is set to the same value.

The lack portions $e_1$, $e_2$, $e_3$, $e_4$ can be formed in the straight layers in such a manner that the shaft flexural rigidity at the butt end B is 20%~50% lower than that of a shaft assuming that the straight layers does not have any lack portions.

Although the straight layers $\mathbf{2}B_1$, $\mathbf{2}B_2$, $\mathbf{2}B_3$, $\mathbf{2}B_4$ have one lack each $e_1$, $e_2$, $e_3$, $e_4$ as an example in the above-described embodiments, the lacks may be formed in at least three straight layers in order that the lacks are arranged in the circumferential direction of the shaft in a well-balanced manner. One lack or more may be also formed in a straight layer.

The straight layer group 2B can be composed of at least three straight layers.

A golf club and a fiber reinforced resin golf club shaft suitable for a swinger according to the present invention can be used for both a wood type and an iron type.

EXAMPLE 1

Two types of test shafts 1, 2 of the structures shown in FIGS. 2 and 3 were prepared and then the same grips and club heads were attached to the test shafts 1, 2, whereby two test clubs 1, 2 composed of the wood type golf club having the number 1 were prepared.

The test shafts 1, 2 are constituted as described below. The physical properties are also shown in Table 1. Both the test shafts are composed of the bias layers of the same structure.

Test Shaft 1:

Structure: shaft S1

Matrix resin of the bias layer group and the straight layer group: epoxy resin

Reinforcing fiber of the bias layer group and the straight layer group: carbon fiber Modulus of elasticity of the reinforcing fibers of the straight layers: 24 ton/mm$^2$ A real weight of fibers in the straight layers: 125 g/m$^2$ Content of fibers in the straight layers: 67%

Tip reinforcing layer: it is arranged between the tip end and the position 400 mm apart from the tip end Parallel reinforcing layer: it is arranged between the tip end and the position 170 mm apart from the tip end Inner diameter of the tip end: 4.5 mm Outer diameter of the tip end: 8.5 mm Inner diameter of the butt end: 12.9 mm Outer diameter of the butt end: 15.3 mm Total shaft length L: 1145 mm Mass of the shaft: 73.9 g Test Shaft 2:

Structure: shaft S2

A real weight of fibers in the first and second straight layers: 150 g/m$^2$

A real weight of fibers in the third and fourth straight layers: 125 g/m$^2$

Lacks: they are arranged between the position 300 mm apart from the butt end toward the tip end and the butt end Tip reinforcing layer: it is arranged between the tip end and the position 250 mm apart from the tip end Parallel reinforcing layer: it is arranged between the tip end and the position 160 mm apart from the tip end Outer diameter of the butt end: 15.4 mm Mass of the shaft: 74.2 g The other constitution is the same as the constitution of the test shaft 1.

TABLE 1

| | Test shaft 1 | Test shaft 2 |
|---|---|---|
| Flexibility (mm) | 70 | 71 |
| Bend point (%) | 43.6 | 43.7 |
| Torsional angle (deg) | 4.1 | 4.1 |
| Position of center of gravity (%) | 54.0 | 53.9 |

Under the conditions of measurement described below, the above-described test clubs were tested by a practical hit feeling test, and then the evaluation was made as to whether or not the trajectory could be obtained as imagined by the golfers. The result shown in Table 2 was obtained.

Practical Hit Feeling Test:

Each swing of many golfers was analyzed by using a high-speed VTR. Then five golfers each regarded as the typical swinger and hitter were selected among them in accordance with their swing types. The golfers hit golf balls by both the test clubs 1, 2. The test result was evaluated as to whether or not the trajectory and feeling could be obtained as imagined by the golfers. O denotes that the trajectory and feeling can be obtained, while X denotes that they cannot be obtained.

TABLE 2

| | Swinger | | | | | Hitter | | | | |
|---|---|---|---|---|---|---|---|---|---|---|
| | 1 | 2 | 3 | 4 | 5 | 1 | 2 | 3 | 4 | 5 |
| Test club 1 | X | X | X | X | X | ○ | ○ | ○ | ○ | ○ |
| Test club 2 | ○ | ○ | ○ | ○ | ○ | X | X | X | X | X |

As can be seen from Table 2, the test club 1, in which the distribution of shaft flexural rigidity in the butt-side portion is within the region higher than the tangent line at the position Q on the reference curve, can be categorized as the golf club for the hitter. On the other hand, the test club 2, in which the distribution is within the region on or lower than the tangent line, can be categorized as the golf club for the swinger.

EXAMPLE 2

The test clubs 1, 2 of EXAMPLE 1 were used so as to carry out the test for evaluating the controllability of carry under the conditions of measurement described below. The result shown in Table 3 was obtained.

Controllability of Carry:

Five superior golfers each, whose handicaps are less than 10 and who are of the swinger type and hitter type, hit golf balls by both the test clubs 1, 2 while controlling the carry. The test result was evaluated by grading according to ten ranks, where the average of marks by five golfers each is rounded off to the first decimal place. The higher this value is, the more excellent the carry controllability is.

TABLE 3

| | Test club 1 | Test club 2 |
|---|---|---|
| Carry controllability | | |
| Swinger | 4.8 | 8.4 |
| Hitter | 7.8 | 2.5 |

As can be seen from Table 3, the test club 2, in which the distribution of shaft flexural rigidity in the butt-side portion is within the region on or lower than the tangent line at from the position Q on the reference curve, is easy to control the carry for the swinger. On the other hand, the test club 1, in which the distribution is within the region higher than the tangent line, is easy to control the carry for the hitter.

EXAMPLE 3

Test shafts 3~7 having the same structure as that of the test shaft 2 in EXAMPLE 1 except that position of the lack starting ends vary in Table 4 were prepared and then the same grips and club needs were attached to them, whereby five test clubs 3~7 composed of the wood type golf club having the number 1 were prepared.

Each test shaft has substantially the same flexibility as the test shaft 2. The bend point, torsional angle and position of the center of gravity of each test shaft are also substantially the same as those of the test shaft 2. The shaft flexural rigidity of each test shaft at a butt end is 20% lower than that of a shaft assuming that each test shaft does not have any lacks in the straight layers.

The test clubs were tested by the practical hit feeling test under the condition of measurement described in EXAMPLE 1 and then the evaluation was made as to whether or not the trajectory could be obtained as imagined by the golfers. The result shown in Table 4 was obtained.

TABLE 4

| | Position of lack | Swinger | | | | | Hitter | | | | |
|---|---|---|---|---|---|---|---|---|---|---|---|
| | starting end (mm) | 1 | 2 | 3 | 4 | 5 | 1 | 2 | 3 | 4 | 5 |
| Test club 3 | 200 | X | X | X | X | X | X | X | X | X | X |
| Test club 4 | 300 | ○ | ○ | ○ | ○ | ○ | X | X | X | X | X |
| Test club 5 | 400 | ○ | ○ | ○ | ○ | ○ | X | X | X | X | X |
| Test club 6 | 500 | ○ | ○ | ○ | ○ | ○ | X | X | X | X | X |
| Test club 7 | 600 | ○ | ○ | ○ | ○ | ○ | X | X | X | X | X |

As can be seen from Table 4, the positions of lack starting ends of the lack portions can be located at least 300 mm apart from the butt end to the tip end. It is realized that the test club 3 having the shaft which has lack portions of which their lack starting ends are located at a position 200 mm from the butt end toward the tip end in the straight layers is not suitable for swingers and hitters to obtain the trajectory as imaged by them. It is because the shaft flexural rigidity in the butt side portion includes both areas beyond and below the tangent line at the position Q of the reference curve 300 mm apart from the butt end. Moreover a test shaft which had lack portions with the lack starting ends starting at a position of 700 mm apart from the butt end and which had substantially the same physical properties as the test shafts 3~7 was not able to be produced. The position of 700 mm is one that is beyond a position of 40% of the total shaft length to the tip end.

As described above, according to the present invention, in the golf club group comprising a plurality of golf clubs having the same number, each shaft of the golf clubs has substantially the same flexibility. The golf club having the shaft of which the distribution of flexural rigidity in the butt-side portion is softened as compared with the tangent line drawn at the position Q of the reference curve is categorized as the one for the swinger. On the other hand, the golf club having the shaft of which the distribution of flexural rigidity is hardened beyond the tangent line, is categorized as the one for the hitter. Therefore, the golf clubs can be categorized so that they may be suitable for the hitting approaches of the swinger and hitter.

What is claimed is:

1. A golf club group comprising a plurality of golf clubs of the same number including a swinger golf club and a hitter golf club having shafts of approximately the same flexibility, each shaft having a length between a tip end and a butt end and including a plurality of bias layers and a plurality of straight layers formed to be shaped into a tapered circular configuration having a diameter that gradually increases towards the butt end of the shaft, each of said plurality of bias layers having reinforcing fibers arranged obliquely to an axial direction of the shaft, each of said plurality of straight layers having reinforcing fibers arranged parallel to the axial direction of the shaft, wherein said swinger golf club has a shaft with a distribution of flexural rigidity over the length thereof that is represented by relation to a reference curve resulting from plotting units of flexural rigidity against units of shaft length for an assumed shaft in which said plurality of straight layers of the swinger golf club have a constant thickness from the tip end to the butt end, such that flexural rigidity in a portion of the swinger golf club shaft length from a position Q, that is spaced about 300 mm from the butt end, to the butt end, is represented by a plot region of the reference curve on or lower than a line tangent to the reference curve at the position Q, and said hitter golf club has a shaft with a distribution of flexural rigidity over the length thereof that is represented by relation to a reference curve resulting from plotting units of flexural rigidity against units of shaft length for an assumed shaft in which said plurality of straight layers of the hitter golf club have a constant thickness from the tip end to the butt end, such that flexural rigidity in a portion of the hitter golf club shaft length from the position Q to the butt end is represented by a plot region of the reference curve higher than a line tangent to the reference curve at the position Q.

2. The golf club group according to claim 1, wherein said plurality of straight layers of the swinger golf club include at least three layers having lengths equal to each other in the axial direction of the shaft, each of the at least three straight layers having at least one lack portion within at least the region from said position Q to the butt end, the lack portion having a width that gradually increases towards the butt end, and the lack portions of the at least three straight layers being substantially equally spaced in a circumferential direction of the shaft.

3. The golf club group according to claim 2, wherein a starting end of each of said lack portions is located between a position corresponding to 40% of the total shaft length from said tip end and said position Q.

4. The golf club group according to claim 1, wherein said plurality of straight layers of the hitter golf club include at least three layers having lengths equal to each other in the axial direction of the shaft, and said plurality of straight layers have a constant thickness from the tip end to the butt end.

5. The golf club group according to claim 1, wherein said plurality of golf club shafts have the same total shaft length.

6. The golf club group according to claim 1, wherein said reinforcing fibers are carbon fibers.

7. The golf club group according to claim 6, wherein said plurality of golf club shafts have the same number of bias layers and the same number of straight layers.

* * * * *